US006135895A

United States Patent [19]

Estivo et al.

[11] Patent Number: 6,135,895

[45] Date of Patent: Oct. 24, 2000

[54] GOLF TRAINING SYSTEM

[76] Inventors: Robert Estivo, 18087 Sailfish Dr., Lutz, Fla. 33549; Albert Murphy, Jr., 4108 W. North B St., Tampa, Fla. 36609

[21] Appl. No.: 09/379,546

[22] Filed: Aug. 23, 1999

[51] Int. Cl.[7] ..... A63B 57/00

[52] U.S. Cl. ..... 473/278; 473/279; 473/261; 473/269

[58] Field of Search ..... 473/219, 278, 473/279, 137–147, 261, 269

[56] References Cited

U.S. PATENT DOCUMENTS

| | | | |
|---|---|---|---|
| 2,297,118 | 9/1942 | Wildegans | 473/147 |
| 3,639,923 | 2/1972 | Stewart | 473/278 |
| 3,936,055 | 2/1976 | Scott | 273/176 |
| 4,222,568 | 9/1980 | Russo | 273/176 |
| 4,346,896 | 8/1982 | Russell et al. | 473/279 |
| 4,609,197 | 9/1986 | Vodin | 473/144 |
| 4,779,796 | 10/1988 | Lai | 473/278 |
| 4,978,127 | 12/1990 | Juel, Jr. | 273/176 |
| 5,171,016 | 12/1992 | Kamal | 273/176 |
| 5,390,925 | 2/1995 | Wiltse | 273/176 |
| 5,431,403 | 7/1995 | Pelz | 273/178 |

*Primary Examiner*—Jeanette Chapman
*Assistant Examiner*—Raeann Gordon
*Attorney, Agent, or Firm*—Joseph N. Breaux

[57] ABSTRACT

A golf training system that includes a stance platform having four adjustable height legs to allow the user to simulate swinging at different angles. The stance platform includes multiple ball connecting apertures so that the user can practice at several angles without the need for adjusting the adjustable height legs. The golf stance platform is foldable into a suit case configuration and carriable by a handle.

1 Claim, 4 Drawing Sheets

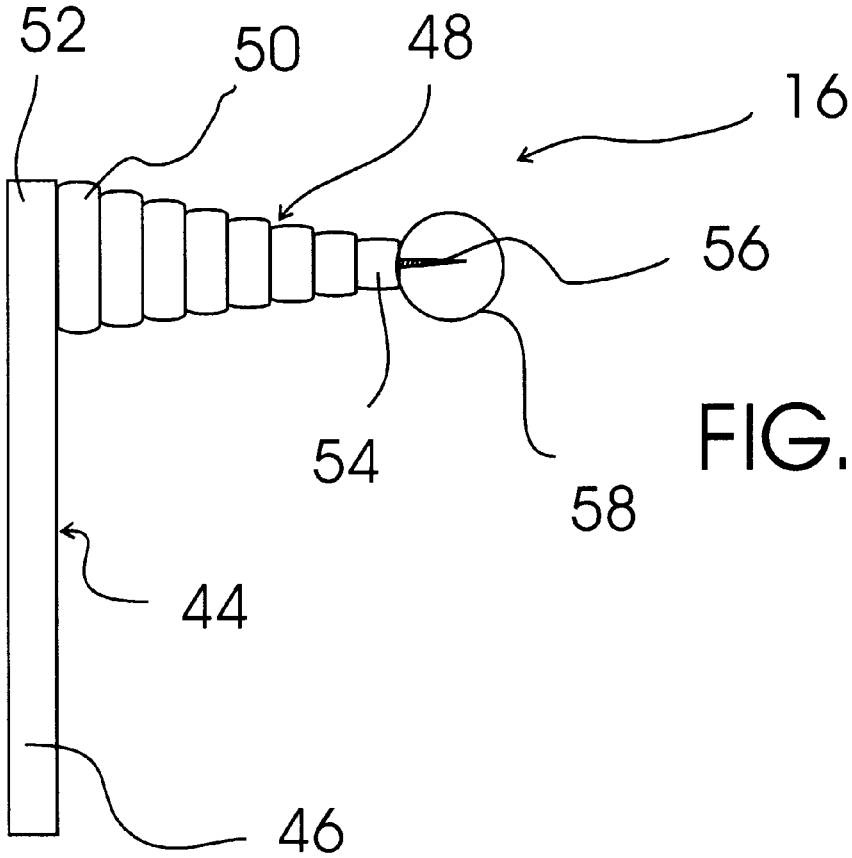
FIG.3A
FIG.8
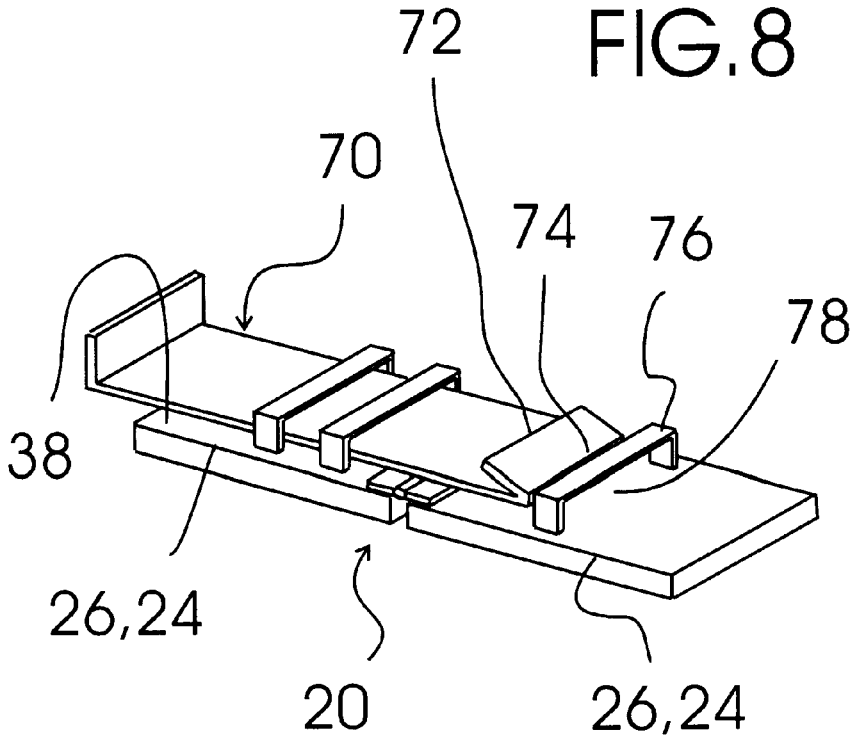

FIG.7
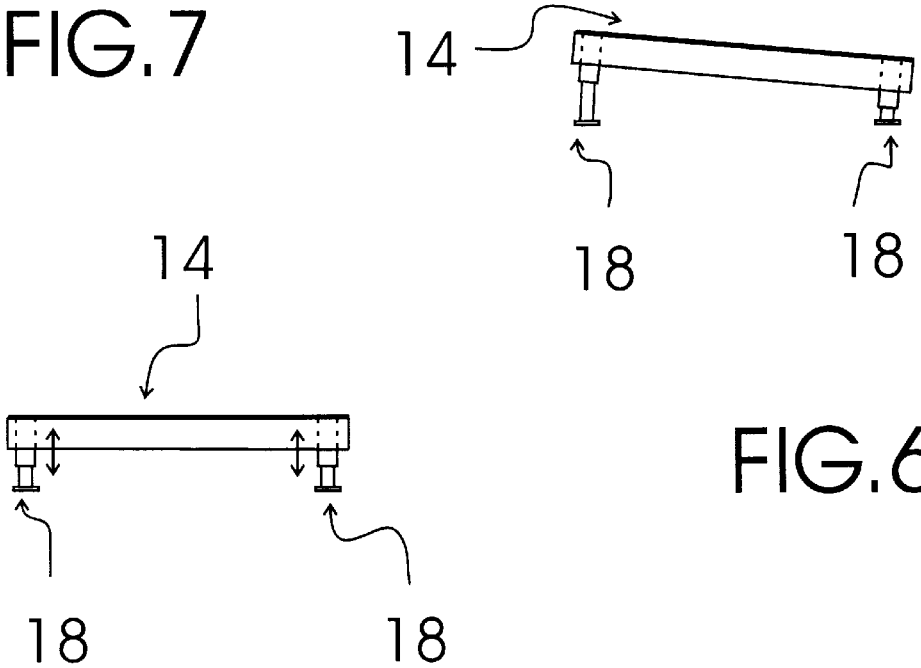
FIG.6
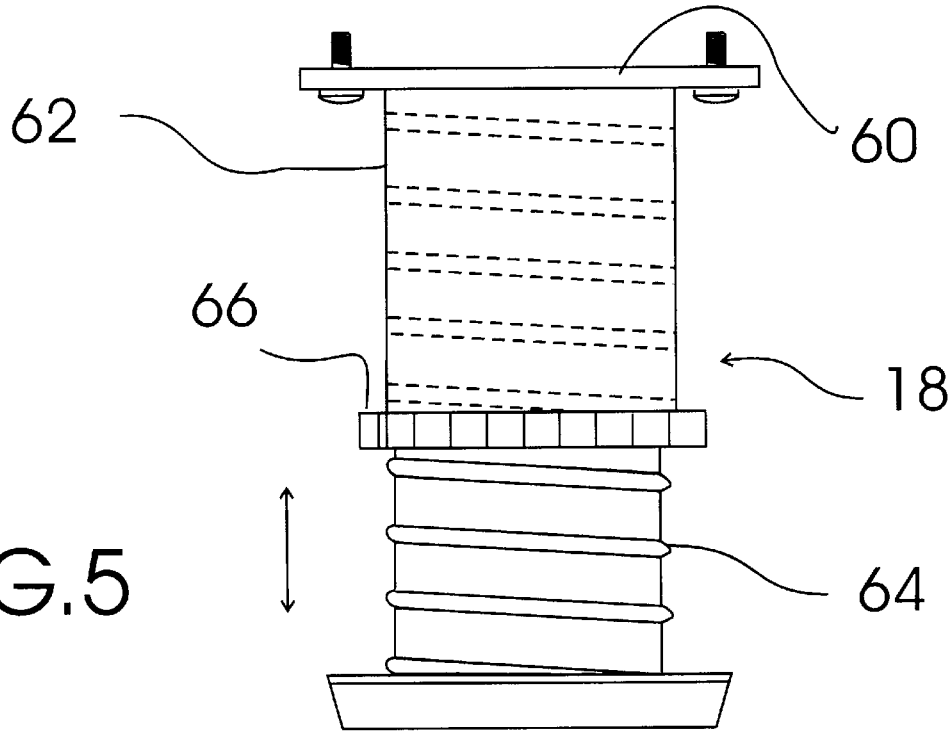
FIG.5

GOLF TRAINING SYSTEM

TECHNICAL FIELD

The present invention relates to golf training devices and more particularly to a golf training system that includes a foldable stance platform, a rotatable ball support assembly, four identical adjustable height support legs, and a slidable locking bar assembly; the foldable stance platform including left and right hingedly connected platform sections connected at adjacent side edges by a hinge assembly, each left and right hingedly connected platform section including an artificial grass covered upper surface having an attachment aperture formed thereinto for providing a connection site with the rotatable ball support assembly and an underside surface to which two of the four identical adjustable height support legs are attached, a shaped ball support assembly storage cavity for storing the rotatable ball support assembly being formed into the underside surface of one of the left and right hingedly connected platform sections; the foldable stance platform further including a set of locking assemblies secured on opposite side ends of the left and right hingedly connected platform sections to hold the left and right hingedly connected platform sections in a closed position when folded at the hinge assembly, and a handle attached to one of the side ends at one of the left and right hingedly corrected platform sections; the rotatable ball support assembly being detachably connectable to each of the attachment apertures of the foldable stance platform and including a rotatable support shaft having a bottom end shaped and sized to rotatably fit into each of the two attachment apertures formed into the artificial grass covered upper surface of the foldable stance platform, a cone shaped support spring having a large diameter first spring end rigidly affixed to a top end side surface of the rotatable support shaft and a small diameter second spring end provided with a ball attachment screw, and a golf ball having the ball attachment screw screwed thereinto to hold the golf ball in connection with the support spring; each of the four identical adjustable height support legs including a platform attachment bolt plate integrally formed with an internally threaded leg member receiving tube and bolted to an underside surface of one of the left and right hingedly connected platform sections, an externally threaded leg member threadably connected to the internally threaded leg member receiving tube, and a locking ring threadably positioned on the externally threaded leg member; the slidable locking bar assembly including a slidable locking bar with a spring loaded, angled retaining mechanism at the tip end thereof slidably mounted to an underside surface of another one of the left and right hingedly connected platform sections and defining a retaining mechanism passage aperture through which the spring loaded, angled retaining mechanism is insertable when compressed.

BACKGROUND ART

Golf enthusiasts can often improve their playing skills by practicing in a simulated golf environment. It would be a benefit, therefore, to have a golf training system that included a stance platform that included four adjustable height legs to allow the user to practice swinging at different angles. Because adjusting the stance platform can be time consuming, it would be a further benefit to have a stance platform that included multiple ball connecting apertures so that the user could practice at several angles without the need for adjusting the adjustable height legs. Because a user may desire to use the golf training system in different locations, it would be further desirable to have a golf stance platform that is foldable into a suit case configuration and carriable by a handle.

GENERAL SUMMARY DISCUSSION OF INVENTION

It is thus an object of the invention to provide a golf training system that includes a foldable stance platform, a rotatable ball support assembly, four identical adjustable height support legs, and a slidable locking bar assembly; the foldable stance platform including left and right hingedly connected platform sections connected at adjacent side edges by a hinge assembly, each left and right hingedly connected platform section including an artificial grass covered upper surface having an attachment aperture formed thereinto for providing a connection site with the rotatable ball support assembly and an underside surface to which two of the four identical adjustable height support legs are attached, a shaped ball support assembly storage cavity for storing the rotatable ball support assembly being formed into the underside surface of one of the left and right hingedly connected platform sections; the foldable stance platform further including a set of locking assemblies secured on opposite side ends of the left and right hingedly connected platform sections to hold the left and right hingedly connected platform sections in a closed position when folded at the hinge assembly, and a handle attached to one of the side ends of one of the left and right hingedly connected platform sect ions; the rotatable ball support assembly being detachably connectable to each of the attachment apertures of the foldable stance platform and including a rotatable support shaft having a bottom end shaped and sized to rotatably fit into each of the two attachment apertures formed into the artificial grass covered upper surface of the foldable stance platform, a cone shaped support spring having a large diameter first spring end rigidly affixed to a top end side surface of the rotatable support shaft and a small diameter second spring end provided with a ball attachment screw, and a golf ball having the ball attachment screw screwed thereinto to hold the golf ball in connection with the support spring; each of the four identical adjustable height support legs including a platform attachment bolt plate integrally formed with an internally threaded leg member receiving tube and bolted to an underside surface of one of the left and right hingedly connected platform sections, an externally threaded leg member threadably connected to the internally threaded leg member receiving tube, and a locking ring threadably positioned on the externally threaded leg member; the slidable locking bar assembly including a slidable locking bar with a spring loaded, angled retaining mechanism at the tip end thereof slidably mounted to an underside surface of another one of the left and right hingedly connected platform sections and defining a retaining mechanism passage aperture through which the spring loaded, angled retaining mechanism is insertable when compressed.

Accordingly, a golf training system is provided. The golf training system includes a foldable stance platform, a rotatable ball support assembly, four identical adjustable height support legs, and a slidable locking bar assembly; the foldable stance platform including left and right hingedly connected platform sections connected at adjacent side edges by a hinge assembly, each left and right hingedly connected platform section including an artificial grass covered upper surface having an attachment aperture formed thereinto for providing a connection site with the rotatable ball support assembly and an underside surface to which two of the four identical adjustable height support legs are attached, a shaped ball support assembly storage cavity for storing the rotatable ball support assembly being formed into the underside surface of one of the left and right hingedly connected platform sections; the foldable stance platform further including a set of locking assemblies secured on opposite side ends of the left and right hingedly connected platform sections to hold the left and right hingedly connected platform sections in a closed position when folded at the hinge assembly, and a handle attached to one of the side ends of one of the left and right hingedly connected platform sections; the rotatable ball support assembly being detachably connectable to each of the attachment apertures of the foldable stance platform and including a rotatable support shaft having a bottom end shaped and sized to rotatably fit into each of the two attachment apertures formed into the artificial grass covered upper surface of the foldable stance platform, a core shaped support spring having a large diameter first spring end rigidly affixed to a top end side surface of the rotatable support shaft and a small diameter second spring end provided with a ball attachment screw, and a golf ball having the ball attachment screw screwed thereinto to hold the golf ball in connection with the support spring; each of the four identical adjustable height support legs including a platform attachment bolt plate integrally formed with an internally threaded leg member receiving tube and bolted to an underside surface of one of the left and right hingedly connected platform sections, an externally threaded leg member threadably connected to the internally threaded leg member receiving tube, and a locking ring threadably positioned on the externally threaded leg member; the slidable locking bar assembly including a slidable locking bar with a spring loaded, angled retaining mechanism at the tip end thereon slidably mounted to an underside surface of another one of the left and right hingedly connected platform sections and defining a retaining mechanism passage aperture through which the spring loaded, angled retaining mechanism is insertable when compressed.

BRIEF DESCRIPTION OF DRAWINGS

For a further understanding of the nature and objects of the present invention, reference should be made to the following detailed description, taken in conjunction with the accompanying drawings, in which like elements are giver the same or analogous reference numbers and wherein:

FIG. 3A is a side plan view of the detachably connectable, rotatable ball support assembly in isolation showing the rotatable support shaft having a bottom end shaped and sized to rotatably fit into each of the two attachment apertures formed into the artificial grass covered upper surface of the foldable stance platform, the cone shaped support spring having a first spring end rigidly affixed to a top end side surface of the rotatable support shaft and a second spring end provided with a ball attachment screw, and a golf ball having the ball attachment screw screwed thereinto to hold the golf ball in connection with the support spring.

FIG. 5 is a side plan view of one of the four identical adjustable height support legs showing the platform attachment bolt plate integrally formed with the internally threaded leg member receiving tube, the externally threaded leg member threadably connected to the internally threaded leg member receiving tube, and the locking ring threadably position on the externally threaded leg member.

FIG. 6 is a side plan view showing the foldable stance platform in the unfolded configuration and the four adjustable height legs adjusted to support the foldable stance platform in a substantially horizontal position.

FIG. 7 is a side plan view showing the foldable stance platform in the unfolded configuration and the four adjustable height legs adjusted to support the foldable stance platform in an angled position.

FIG. 8 is a detail perspective view of one of the three slidable locking bar assemblies in isolation showing the slidable locking bar with the spring loaded, angled retaining mechanism at the tip end thereof that is compressible to allow the spring loaded, angled retaining mechanism to slide under and be retained by a retaining structure.

EXEMPLARY MODE FOR CARRYING OUT THE INVENTION

Figure 1:
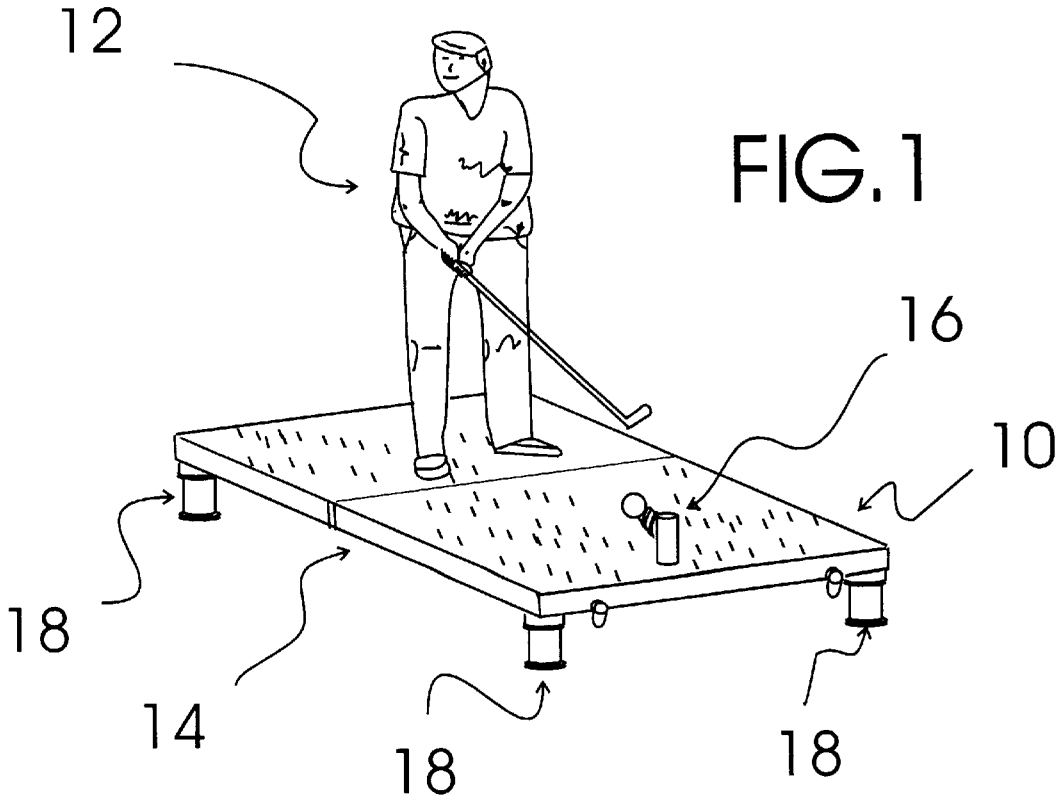
FIG. 1 is a perspective view of an exemplary embodiment of the golf training system of the present invention showing the foldable stance platform in the open configuration with the detachably connectable, rotatable ball support assembly rotatably coupled to an artificial grass covered upper surface thereof and four adjustable height support legs (see FIG. 4) supporting the foldable stance platform at an angle.
Figure 4:
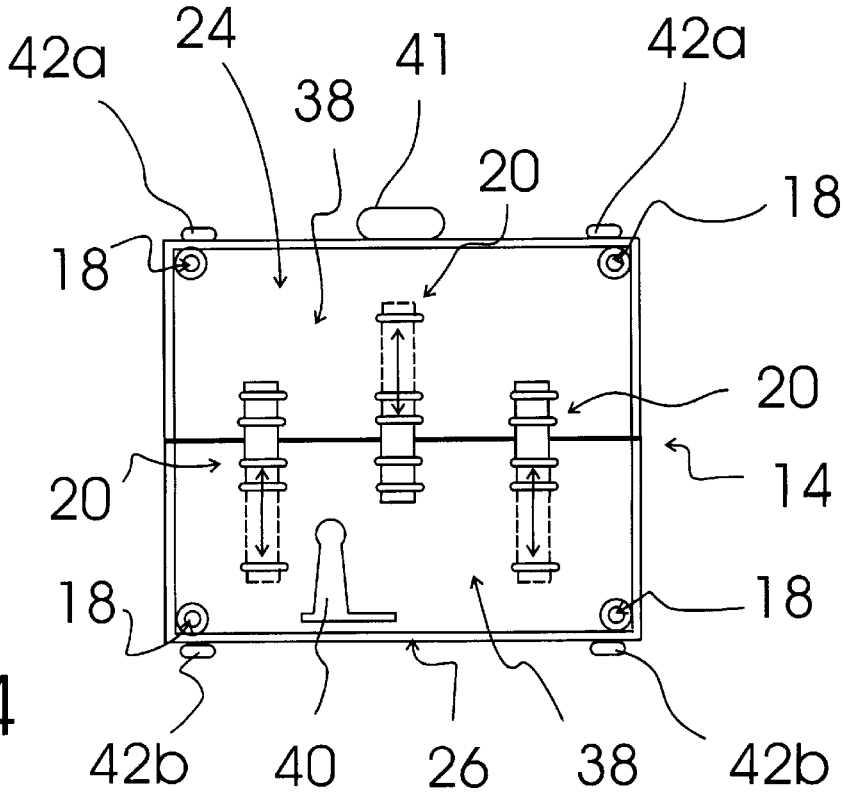
FIG. 4 is an underside plan view of the exemplary golf training system of FIG. 1 showing the foldable stance platform locked in the open configuration with the three slidable locking bar assemblies secured to and between the left and right hingedly connected platform sections, the hinge assembly secured between adjacent side edges of the left and right hingedly connected platform sections, the four adjustable height support legs, one provided in each underside corner of the foldable stance platform, and the form shaped ball support assembly storage cavity formed into the underside surface of the foldable stance platform.

FIG. 1 shows an exemplary embodiment of the golf training system of the present invention, generally designated 10, in use by a representative golfer 12. Golf training system 10 includes a foldable stance platform, generally designated 14; a rotatable ball support assembly, generally designated 16; four identical adjustable height support legs, each generally designated 18 (see also FIG. 4); and three slidable locking bar assembly, each generally designated 20 (FIG. 4).

Figure 2:
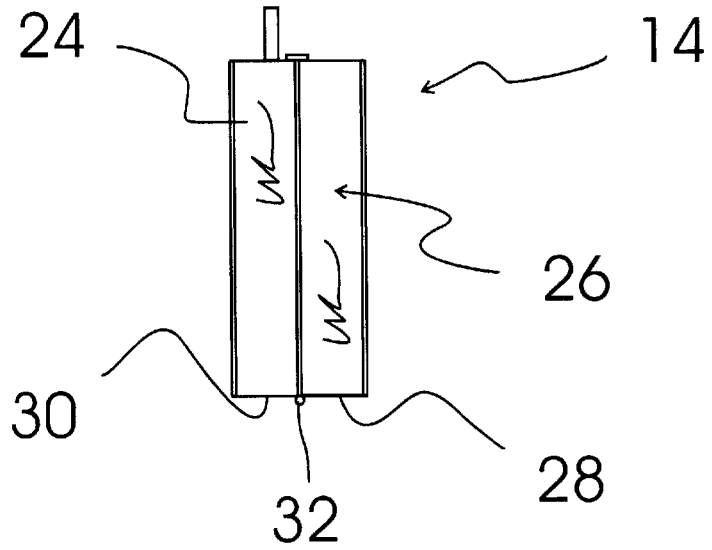
FIG. 2 is a side plan view of the exemplary golf training system of FIG. 1 with the adjustable height support legs in the withdrawn position, the detachably connectable, rotatable ball support assembly detached from the artificial grass covered upper surface of the foldable stance platform and the foldable stance platform with the left and right hingedly connected platform sections folded together and held in place by the locking assemblies and carriable with the handle.
Figure 3:
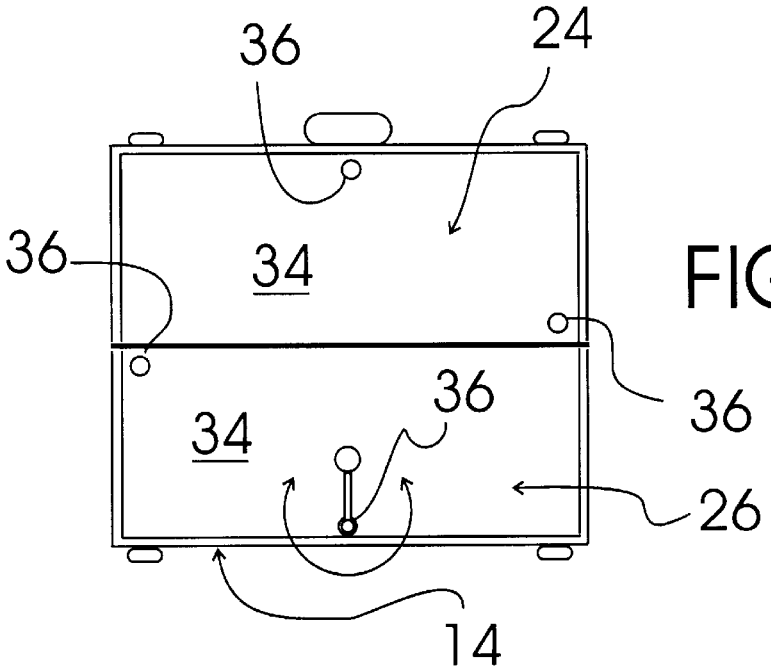
FIG. 3 is a top plan view of the exemplary golf training system of FIG. 1 showing the detachably connectable, rotatable ball support assembly rotatably coupled to one of two attachment apertures formed into the artificial grass covered upper surface of the foldable stance platform, the two sets of locking assemblies secured on opposed side ends, and the handle attached to one of the side ends.

Referring to FIG. 2, foldable stance platform 14 is foldable into a closed suitcase configuration for storage and carrying and includes left and right hingedly connected platform sections, generally designated 24, 26; connected at adjacent side edges 28, 30 by a hinge assembly 32. Referring to FIG. 3, left and right hingedly connected platform sections 24, 26 each include an artificial grass covered upper surface 34 having two attachment apertures 36 formed thereinto for providing a connection site with rotatable ball support assembly 16 and, referring now to FIG. 4, an underside surface, generally designated 38, to which two of the four identical adjustable height support legs 18 are attached. A shaped ball support assembly storage cavity 40 for storing the rotatable ball support assembly 16 (FIGS. 1, 2) is formed into underside surface 38 of right hingedly connected platform section 26. Foldable stance platform 14 also includes a handle 41 and two sets of locking assemblies 42*a*, 42*b* secured on opposite side ends of the left and right hingedly connected platform sections 24, 26 to hold the left and right hingedly connected platform sections 24, 26 in a closed position (FIG. 2) when folded at hinge assembly 32 (FIG. 2).

Referring to FIG. 3A, rotatable ball support assembly 16 is detachably connectable to each of the attachment apertures 36 (FIG. 3) of foldable stance platform 14 (FIG. 1) and includes a rotatable support shaft, generally designated 44, having a bottom end 46 shaped and sized to rotatably fit into each of the four attachment apertures 36 (FIG. 3) formed into artificial grass covered upper surface 34 (FIG. 3) of foldable stance platform 14; a cone shaped support spring, generally designated 48, having a large diameter first spring end 50 rigidly affixed to a top end 52 side surface of rotatable support shaft 44 and a small diameter second spring end 54 provided with a ball attachment screw 56 (shown in dashed lines), and a golf ball 58 having ball attachment screw 56 screwed thereinto to hold golf ball 58 in connection with support spring 48. Use of a cone shaped support spring 48 provides less interaction between support spring 48 and the head of a golf club when in use.

Referring to FIG. 5, each of the four identical adjustable height support legs 18 includes a platform attachment bolt plate 60 integrally formed with an internally threaded leg member receiving tube 62 and bolted to an underside surface 38 of one of the left and right hingedly connected platform sections 24, 26 (FIG. 4), an externally threaded leg member 64 threadably connected to internally threaded leg member receiving tube 62, and a locking ring 66 threadably positioned on externally threaded leg member 64.

Referring to FIGS. 6 and 7, in use the height of adjustable height legs 18 are adjusted by the user to orient the foldable stance platform 14 at a desired angle. Proving foldable stance platform with four attachment apertures 36 (FIG. 3) allows the user to easily practice at different angles without the need for readjustment of adjustable height legs 18.

Referring to FIG. 6, slidable locking bar assemblies 20 (FIG. 4) each include a slidable locking bar, generally designated 70 with a spring loaded, angled retaining mechanism 72 at the tip end 74 thereof slidably mounted to underside surface 38 of one of the left and right hingedly connected platform sections 24, 26 and a retaining structure 76 defining a retaining mechanism passage aperture 18 through which spring loaded, angled retaining mechanism 72 is insertable when compressed. Slidable locking bar assemblies 20 prevent left and right hingedly connected platform sections 24, 26 from pivoting with respect to each other when spring loaded, angled retaining mechanism 72 is inserted through retaining mechanism passage aperture 78.

It can be seen from the preceding description that a golf training system has been provided that includes a foldable stance platform, a rotatable ball support assembly, four identical adjustable height support legs, and a slidable locking bar assembly; the foldable stance platform including left and right hingedly connected platform sections connected at adjacent side edges by a hinge assembly, each left and right hingedly connected platform section including at artificial grass covered upper surface having an attachment aperture formed thereinto for providing a connection site with the rotatable ball support assembly and an underside surface to which two of the four identical adjustable height support legs are attached, a shaped ball support assembly storage cavity for storing the rotatable ball support assembly being formed into the underside surface of one of the left and right hingedly connected platform sections; the foldable stance platform further including a set of locking assemblies secured on opposite side ends of the left and right hingedly connected platform sections to hold the left and right hingedly connected platform sections in a closed position when folded at the hinge assembly, and a handle attached to one of the side ends of one of the left and right hingedly connected platform sections; the rotatable ball support assembly being detachably connectable to each of the attachment apertures of the foldable stance platform and including a rotatable support shaft having a bottom end shaped and sized to rotatably fit into each of the two attachment apertures formed into the artificial grass covered upper surface of the foldable stance platform, a cone shaped support spring having a large diameter first spring end rigidly affixed to a top end side surface of the rotatable support shaft and a small diameter second spring end provided with a ball attachment screw, and a golf ball having the ball attachment screw screwed thereinto to hold the golf ball in connection with the support spring; each of the four identical adjustable height support legs including a platform attachment bolt plate integrally formed with an internally threaded leg member receiving tube and bolted to an underside surface of one of the left and right hingedly connected platform sections, an externally threaded leg member threadably connected to the internally threaded leg member receiving tube, and a locking ring threadably positioned on the externally threaded leg member; the slidable locking bar assembly including a slidable locking bar with a spring loaded, angled retaining mechanism at the tip end thereof slidably mounted to an underside surface of another one of the left and right hingedly connected platform sections and defining a retaining mechanism passage aperture through which the spring loaded, angled retaining mechanism is insertable when compressed.

It is noted that the embodiment of the golf training system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A golf training system comprising:

a foldable stance platform;

a rotatable ball support assembly;

four identical adjustable height support legs; and a slidable locking bar assembly;

said foldable stance platform including left and right hingedly connected platform sections connected at adjacent side edges by a hinge assembly, each left and right hingedly connected platform section including an artificial grass covered upper surface having an attachment aperture formed thereinto for providing a connection site with said rotatable ball support assembly and an underside surface to which two of said four identical adjustable height support legs are attached, a shaped ball support assembly storage cavity for storing said rotatable ball support assembly being formed into said underside surface of one of said left and right hingedly connected platform sections;

said foldable stance platform further including a set of locking assemblies secured on opposite side ends of said left and right hingedly connected platform sections to hold said left and right hingedly connected platform sections in a closed position when folded at said hinge assembly, and a handle attached to one of said side ends of one of said left and right hingedly connected platform sections;

said rotatable ball support assembly being detachably connectable to each of said attachment apertures of said foldable stance platform and including a rotatable support shaft having a bottom end shaped and sized to rotatably fit into each of said two attachment apertures formed into said artificial grass covered upper surface of said foldable stance platform, a cone shaped support spring having a large diameter first spring end rigidly affixed to a top end side surface of said rotatable support shaft and a small diameter second spring end provided with a ball attachment screw, and a golf ball having said ball attachment screw screwed thereinto to hold said golf ball in connection with said support spring;

each of said four identical adjustable height support legs including a platform attachment bolt plate integrally formed with an internally threaded leg member receiving tube and bolted to an underside surface of one of said left and right hingedly connected platform sections, an externally threaded leg member threadably connected to said internally threaded leg member receiving tube, and a locking ring threadably positioned on said externally threaded leg member;

said slidable locking bar assembly including a slidable locking bar with a spring loaded, angled retaining mechanism at said tip end thereof slidably mounted to an underside surface of another one of said left and right hingedly connected platform sections and a retaining structure mounted to said underside surface of a remaining on one of said left and right hingedly connected platform sections defining a remaining mechanism passage aperture through which said spring loaded, angled retaining mechanism is insertable when compressed.

* * * * *